United States Patent [19]

Mace et al.

[11] Patent Number: 4,912,481

[45] Date of Patent: Mar. 27, 1990

[54] COMPACT MULTI-FREQUENCY ANTENNA ARRAY

[75] Inventors: Alan R. Mace, Millersville; Gary E. Evans, Trappe, both of Md.

[73] Assignee: Westinghouse Electric Corp., Pittsburgh, Pa.

[21] Appl. No.: 293,021

[22] Filed: Jan. 3, 1989

[51] Int. Cl.[4] ..... H01Q 1/38

[52] U.S. Cl. ..... 343/700 MS; 343/846; 343/853

[58] Field of Search ..... 343/700 MS, 725, 829, 343/830, 846, 853

[56] References Cited

U.S. PATENT DOCUMENTS

| | | | |
|---|---|---|---|
| 4,367,474 | 1/1983 | Schaubert et al. | 343/700 MS |
| 4,379,296 | 5/1983 | Farrar et al. | 343/700 MS |
| 4,450,449 | 5/1984 | Jewitt | 343/700 MS |

*Primary Examiner*—Rolf Hille
*Assistant Examiner*—Doris J. Johnson
*Attorney, Agent, or Firm*—G. S. Grunebach

[57] ABSTRACT

A radar antenna utilizes groups of high frequency patch radiating element which are configured to function at two frequencies. The groups of patch radiators are configured to have a wide bandwidth and to make efficient use of the aperture while maintaining a thin cross-section.

14 Claims, 4 Drawing Sheets

COMPACT MULTI-FREQUENCY ANTENNA ARRAY

BACKGROUND OF THE INVENTION

1. Field of the Invention.

The present invention relates to a patch radiating antenna array, specifically an array utilizing groupings of high frequency patches, closely spaced to produce simultaneously a low frequency array.

2. Description of the Prior Art

It is often advantageous to radiate or receive two or more radio frequencies from a single antenna. If that antenna is to also be a phased array antenna it is also advantageous that the antenna be very thin.

Patch radiators used in arrays, such as microwave or millimeter wave power radiating elements, are a well established means of achieving planar, thin printed circuit antennas.

However, several problems result when patch radiating elements operable to radiate at two distinct RF frequencies are used on the same array. First, the maximum spacing between the phased patch radiating elements is different for two distinct transmitted frequencies. A high frequency spacing of the patch radiating elements may be less than the minimum practical radiating element size for the low frequency patch radiating element spacing.

Second, widely spaced, low frequency patch radiating elements tend to cause interference lobes in the high frequency transmission patterns of high frequency patch radiating elements.

Thirdly, the physical inter-fitting of occasional low frequency patch radiating elements in the limited space between high frequency patch radiating elements results in a very narrow bandwidth for the emitted signal. Finally, most low frequency patch radiating elements are physically large requiring an extensive surface area.

The U.S. Pat. No. 4,450,449, issued May 22, 1984 to Harold S. Jewitt, entitled "Patch Array Antenna" addressed the need in this area for a multi-frequency array antenna. The patent to Jewitt discloses the use of separate substrate layers etched to produce two individual and distinct patch arrays. These two distinct arrays do not function in a complementary manner and are merely blended together so that the patches of the rear array are behind the open spaces of the front array. For multiple frequency antennas the Jewitt design requires that one array radiate at a first frequency, in a configuration optimally designed for that frequency, while the other array radiates at, and is designed for, a second distinct frequency.

The Jewitt array comprising two distinct non-complementary, radiating systems sharing the same ground plane does not lend itself to effective function as a scanning array radiating antenna. In the frequency scanning mode the patch radiating elements would be farther apart on the array resulting in grading lobes and signal interference.

The problem to be solved therefore is multiple radio frequency power transmission in the low and high frequency range, where for this application the low frequency range is UHF and the high frequency range is the S-band, utilizing high frequency patch radiating elements grouped together and functioning as low frequency patch radiating elements to achieve effective multi-frequency antenna array operation.

SUMMARY OF THE INVENTION

A solution to this problem is presented by the preferred embodiment of this invention, which would allow the transmission of both high and low frequency signals utilizing high frequency patches conformed in groups upon low frequency patches with said high frequency patches functioning as a part of said low frequency transmission system.

A compact multi-frequency antenna array constructed in accordance with this invention includes: a multiplicity of equally spaced patch radiators where these radiators are operable at high radio frequencies. These patch radiators, equally spaced apart define rectangular grids. These rectangular grids are operable at low radio frequencies. Strips of these high frequency patch radiators within the defined rectangular grids multiply the low band patch radiators bandwidth.

This compact, multi-frequency antenna array has a commonly shared ground plane for all of the individual patch radiators, and in another embodiment utilizes an individual ground plane for each individual patch radiator.

A method of shroud aperture signal transmission is also encompassed by this invention.

BRIEF DESCRIPTION OF THE DRAWINGS

For a better understanding of the invention reference may be had to the preferred embodiment exemplary of the invention shown in the accompanying drawings, in which.

DESCRIPTION OF THE PREFERRED EMBODIMENT

Figure 1:
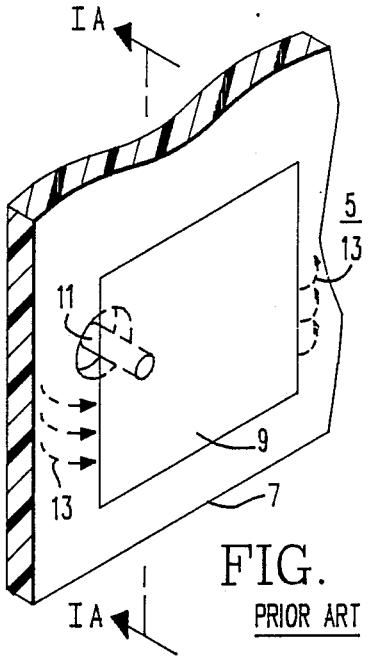
FIG. 1 PRIOR ART
FIG. 1 is an isometric view of the front of the prior art patch radiator.

FIG. 1 is an isometric view of the front surface of a prior art patch radiator 5. The ground plane 7 lies customarily beneath the planar patch radiating element 9 at a distance of approximately $\frac{1}{8}$ of an inch. Input 11 directs a signal into the patch 9. Dielectric material customarily used to support conductor 9 has been left out of FIGS. 1 and 1A for clarity. This signal generates an electromagnetic wave 13, which is directed through the patch as radiated energy.

Figure 1A:
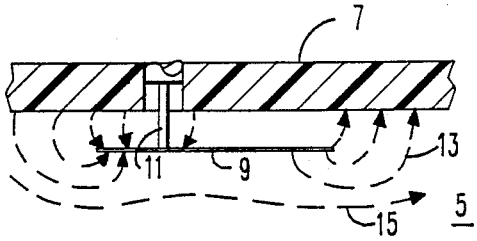
FIG. 1A PRIOR ART
FIG. 1A is a cross-sectional view taken along line IA—IA of the prior art patch radiator of FIG. 1.

FIG. 1A is a cross-sectional view taken along line IA—IA of the patch radiator 5 of FIG. 1. The input signal feeds into the patch 9 through the input 11. The electromagnetic field 13 radiates across the patch 9 forming in a field direction flow 15. Support substrate 7 is shown beneath the patch 9.

Figure 2:
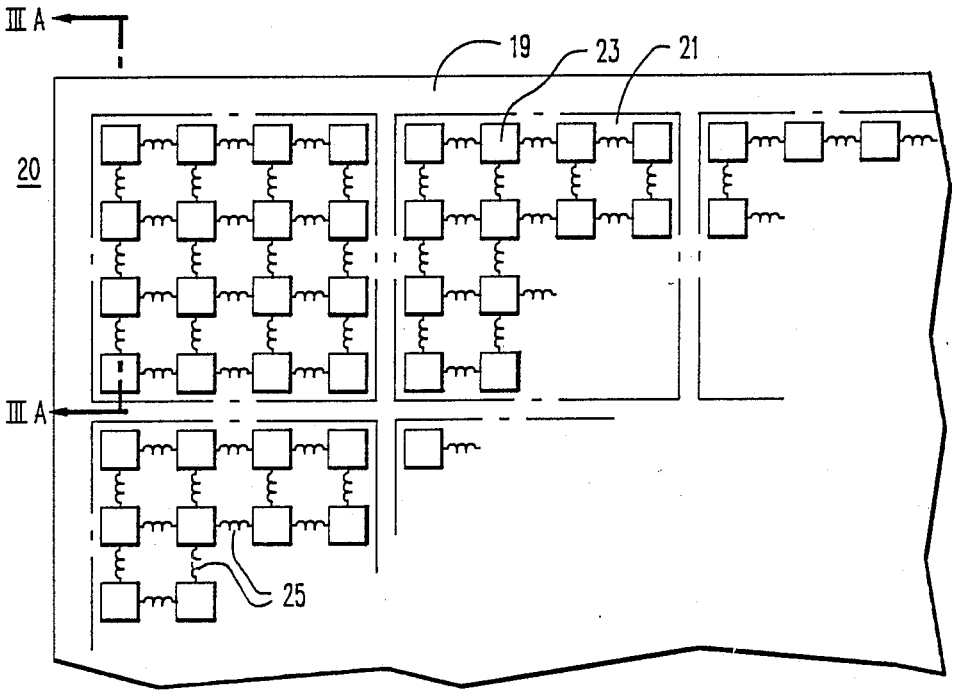
FIG. 2 is a top plan view of a compact multi-frequency array antenna embodiment of the present invention.

FIG. 2 is a top plan view of an embodiment of the invention. This array 20, comprises a multiplicity of high frequency radiators 23 grouped into clusters 21. These high frequency radiators 23 are carefully spaced upon the surface of the substrate 19. There are m×n, rows and columns for each cluster such that the number of radiating elements are approximately the ratio of the low frequency signal to the high frequency signal. In this example, this would be 4000 megahertz to 1000 megahertz. Each patch radiator 23 is interconnected to all other patch radiators by frequency dependent connections 25. In the embodiment 20 shown in FIG. 2, if these frequency dependent connections 25 are open circuited then the array 20 will transmit at a high frequency. If the frequency dependent connections 25 are short circuited then the array 20 will transmit at low frequency. The two problems precluding the use of this embodiment are; the necessarily small ground plane spacing that limits the bandwidth at the lower frequency, and the severe interference present during low frequency operation. That interference is caused by the high frequency waves.

Figure 3A:
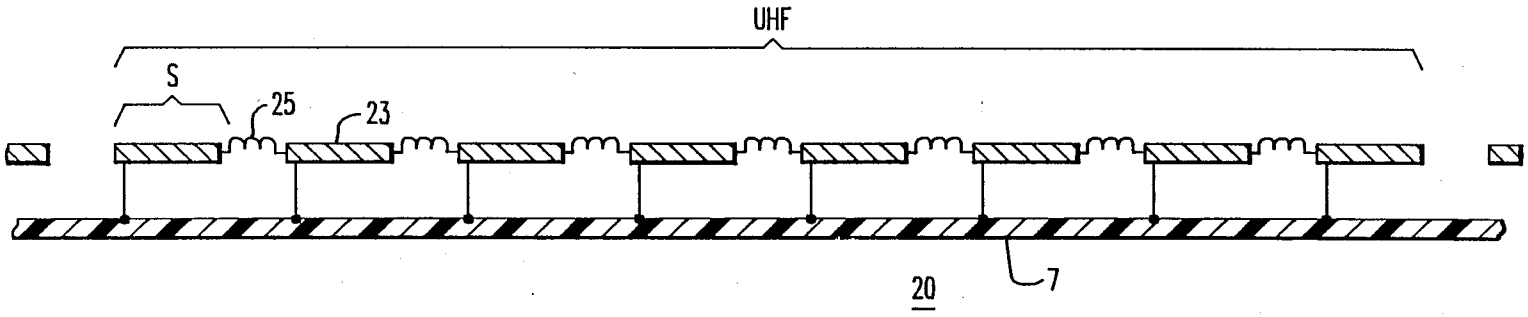
FIG. 3A is a cross-sectional view taken along line IIIA—IIIA of the multi-frequency array antenna of Fig. 2.

FIG. 3A is a cross-sectional view taken along line IIIA—IIIA of the embodiment of FIG. 2. The array 20 with common ground plane 7 is with high frequency radiators 23. These individual radiators, operable in for example the S-band when combined into a grid, result in a low frequency, UHF grid 21. The frequency dependent interconnections 25 between the high frequency radiators 23 are shown.

Figure 3B:
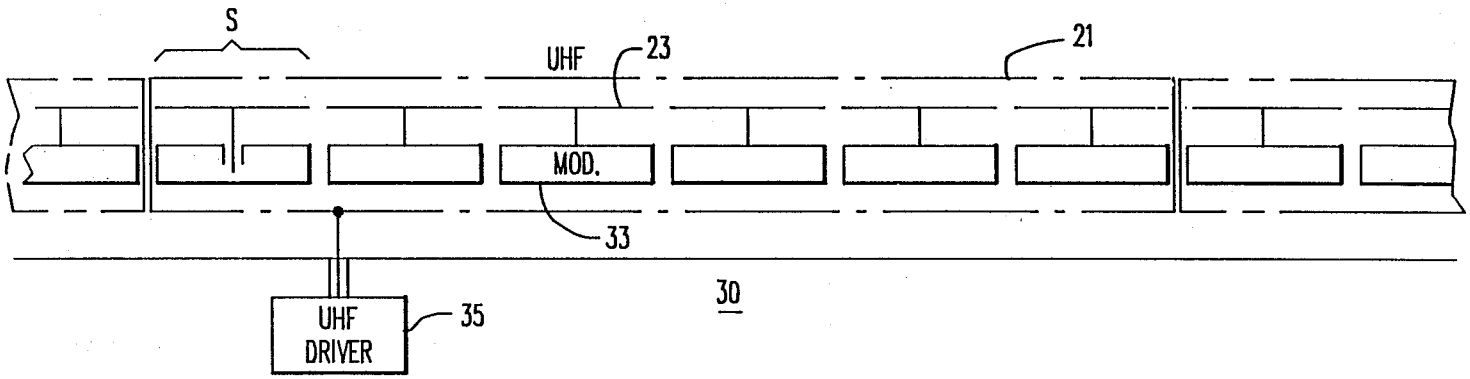
FIG. 3B is a side view of an alternative embodiment utilizing separate ground planes.

FIG. 3B is a side view of a preferred embodiment 30 utilizing separate ground planes 33 for each high frequency radiator 23. The grouped high frequency radiators 23 produce low frequency radiators 21. The UHF low frequency radiators are shown driven by UHF driver 35.

Figure 4:
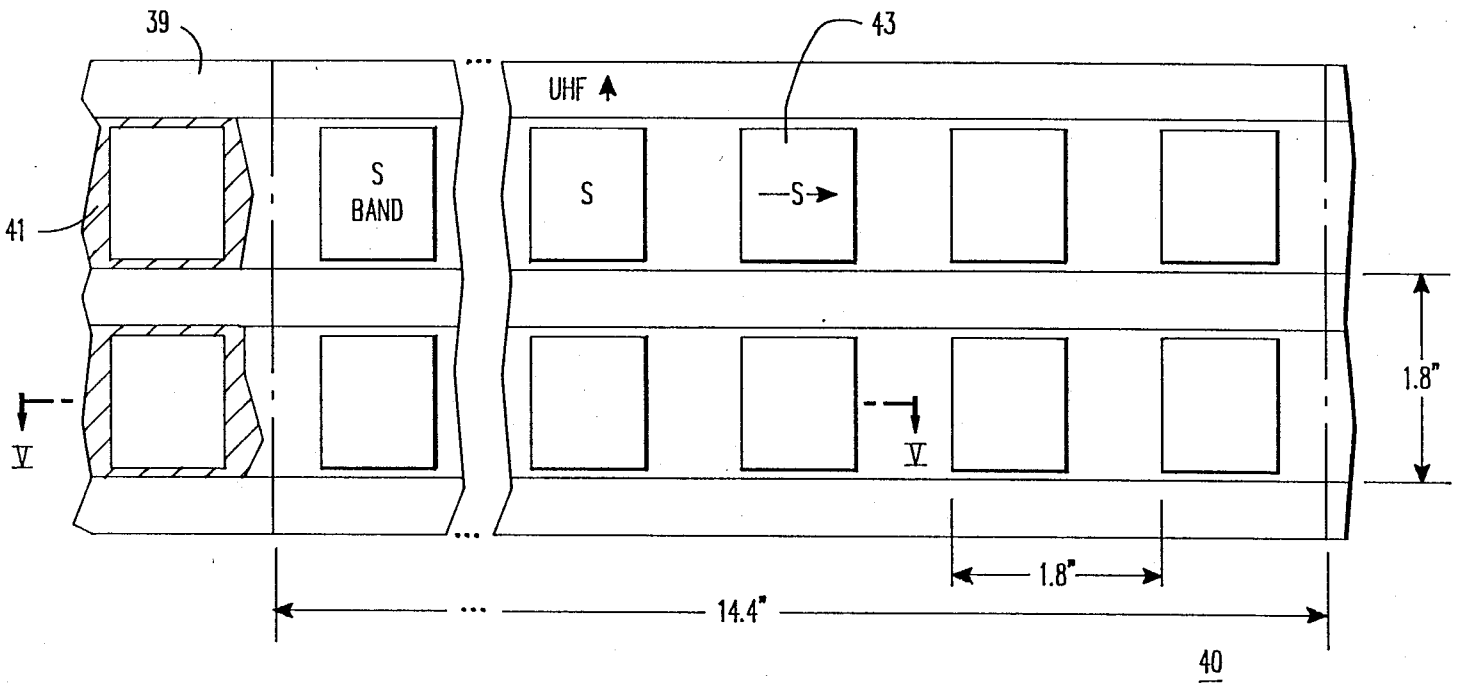
FIG. 4 is a top plan view of an alternative embodiment of the compact multi-frequency array antenna.

FIG. 4 is a top plan view of an alternative embodiment 40 of the compact multi-frequency array antenna. This alternative embodiment has a low frequency signal driven by a driver 39 positioned behind the face of the array. Strips 41 of for example S-band frequency elements or radiators 43 are defined within the grid. This array 40 has dimensions such as the low frequency radiator length $L_1$, of 14.4 inches, a high frequency radiator spacing, $L_2$, of 1.8 inches and a width per strip $LN_1$, of 1.8 inches.

The formula for the spacing of the radiating elements is:

$$S=(\text{wavelength})/(1+\sin(\text{scan angle}))$$

where in a typical configuration $$S=0.5\,\lambda+0.6\,\lambda$$

In a specific example in the UHF range:

$$\lambda=26 \text{ inches where } S=14.4''$$

and for the S-band range:

$$\lambda=3.8 \text{ inches where } S=1.8''$$

Figure 5:
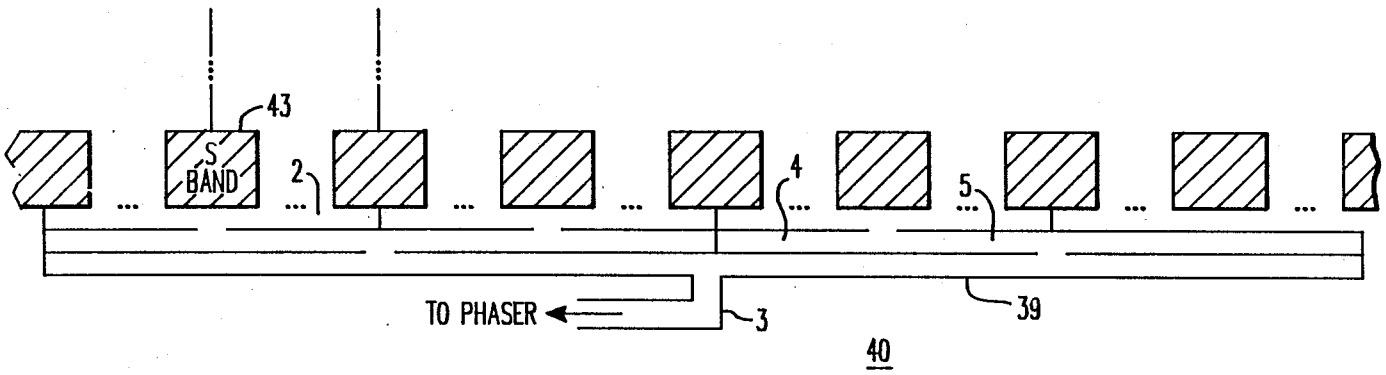
FIG. 5 is a cross-sectional view taken along line VA—VA of the alternative embodiment of the compact multi-frequency array antenna of FIG. 4.

FIG. 5 is a cross-sectional view taken along line VA—VA of the alternative embodiment of FIG. 4. This embodiment 40 demonstrates that not every low band gap need be individually phased because they are less than a half wavelength apart. The multi-frequency array shows a method of feeding a group of eight S-band radiators with UHF transmission capability between the S-band radiators.

In FIG. 5, the S-band radiators 43 are shown spaced eight (8) times as close together as the UHF radiators 39. The UHF signal from the phaser enters the flat corporate divider 5 at the central input 3. This thin waveguide divider, shown in cross section, distributes the signal to the eight gaps 2 between the S-band radiators 43. The impedance transformation from input to output is facilitated by using the spaces 4 as series inductances that effectively raise the impedance of the thin lines. The eight distributed UHF outputs allow an optimum UHF pattern and present an identical gap around every S-band element or radiator 43.

Another embodiment of a dual frequency or multi-frequency transmitting compact radar structure operable in the UHF and S-band comprises: an elevation means, a control structure, an AZ divider and, cold plate in easily replaceable modules. The UHF structure would comprise: a frame structure operable to support the drive and module. This structure comprises 645 band patches per UHF element.

The present invention is directed to an array and a method of transmission for both low frequency and high frequency RF signals utilizing groups of low frequency patch radiators in high frequency configurations such as grids and strips.

The disclosed invention and a method of dual high and low frequency transmission utilizes patch radiators derived from grouping of patches. The high frequency array consists of a rectangular grid of patches, and in theory these patches can be joined together in groups using frequency sensitive connections of an inductive nature. These groupings of high frequency patches produce large patches operable for low frequency transmissions. However, these arrays are not a recommended solution to the joint signal transmission problem.

When the two transmission bands under consideration, one low frequency and one high frequency, are cross polarized then the ground plane gaps are parallel to the high band field and are therefore undetectable. If two bands are copolarized, then these gaps must have the equivalent of a series tuned circuit across them that connects them at the high frequency. The inclusion in the high frequency band ground plane of optional phases and amplifiers into the low frequency patches would eliminate problems in patch spacing.

The large, low frequency patches of the recommended array are broken up into several portions, each of which is a row or strip of high band elements as shown in FIG. 2. It is possible to drive all of the gaps in this manner, if all of the high band elements are alike, with the same gap existing between all the rows. The low band radiator bandwidth is multiplied by the number used. Further, every high band element or radiator is exposed to the same environment. In this application of dual frequency transmission, the low band radiator pattern may be tailored to match the scanning requirements of the antenna array.

Utilizing the described array and method a dual frequency array for high and low frequency (i.e., S-band and UHF band) radar array as described above. This compact multi-frequency array antenna comprises for each band numerable, repairable modules having readily shared cooling or power distribution capabilities.

The described antenna array operable in two different frequency bands results in full performance on both, with little additional space or weight over a prior art single band approach. This concept of utilizing strategically grouped high frequency patches and configured as grids defining larger low frequency patch radiators would have extensive application in airborne, shipboard, and ground based radar systems.

Numerous variations may be made in the above-described combination and in different embodiments of this invention. They may be made without departing form the spirit thereof. Therefore, it is intended that all matter contained in the foregoing description and in the accompanying drawings shall be interpreted as illustrative and thus not in a limiting sense.

We claim:

1. A compact, multi-frequency, antenna array, comprising:

a multiplicity of equally spaced patch radiators, said equally spaced patch radiators configured in rows and columns, said patch radiators operable at high radio frequencies, said patch radiators defining at least one rectangular grid, said rectangular grid of said patch radiators operable at low radio frequencies, further said rectangular grid of equally spaced patch radiators operable to define strips of high frequency patch radiators; and a ground plane, said group plane providing a common ground plane to said multiplicity of equally spaced patch radiators.

2. A method of sharing an aperture among more than one transmitted radio frequency for a radar antenna, said method comprising:

providing a multiplicity of equally spaced patch radiators, said patch radiators configured in rows and columns, said patch radiators operable at high radio frequencies, said patch radiators defining at least one rectangular grid, said rectangular grid defined by said patch radiators operable at low radio frequencies, further said rectangular grid being operable to define strips of high frequency patch radiators; and providing a ground plane, said ground plane operable to be a common ground plane to said multiplicity of equally spaced patch radiators.

3. A compact, multi-frequency antenna array, comprising:

a multiplicity of equally spaced patch radiators, said patch radiators configured in rows and columns, said patch radiators operable at high radio frequencies, said patch radiators defining at least one rectangular grid, said rectangular grid of said patch radiators operable at low radio frequencies, further said rectangular grid of equally spaced patch radiators operable to define strips of high frequency patch radiators; and a multiplicity of ground planes, one of said ground planes cooperatively associated with each of said patch radiators.

4. A method of sharing an aperture among more than one transmitted radio frequency for a radar antenna, said method comprising:

providing a multiplicity of equally spaced patch radiators, said patch radiators configured in rows and columns, said patch radiators operable at high radio frequencies, said patch radiators defining at least one rectangular grid, said rectangular grid defined by said patch radiators operable at low radio frequencies, further said rectangular grid being operable to define strips of high frequency patch radiators; and providing a multiplicity of ground planes, one of said ground planes cooperatively associated with each of said patch radiators.

5. A compact, multi-frequency, antenna array, comprising:

a multiplicity of equally spaced patch radiators, said equally spaced patch radiators configured in rows and columns, said patch radiators operable at high radio frequencies, said patch radiators defining at least two rectangular grids wherein said rectangular grids are spaced less than one-half wavelength of said low radio frequency apart, said rectangular grids of said patch radiators operable at low radio frequencies, further said rectangular grid of equally spaced patch radiators operable to define strips of high frequency patch radiators; and a ground plane, said ground plane providing a common ground plane to said multiplicity of equally spaced patch radiators.

6. A compact, multi-frequency, antenna array, comprising:

a multiplicity of equally spaced patch radiators, said equally spaced patch radiators configured in rows and columns, said patch radiators operable in the S-band, said patch radiators defining at least one rectangular grid, said rectangular grid of said patch radiators operable at low radio frequencies, further said rectangular grid of equally spaced patch radiators operable to define strips of high frequency patch radiators; and a ground plane, said ground plane providing a common ground plane to said multiplicity of equally spaced patch radiators.

7. A compact, multi-frequency, antenna array, comprising:

a multiplicity of equally spaced patch radiators, said equally spaced patch radiators configured in rows and columns, said patch radiators operable at high radio frequencies, said patch radiators defining at least one rectangular grid, said rectangular grid being operable in the UHF band, further said rectangular grid of equally spaced patch radiators operable to define strips of high frequency patch radiators; and a ground plane, said ground plane providing a common ground plane to said multiplicity of equally spaced patch radiators.

8. A compact, multi-frequency, antenna array, comprising:

a multiplicity of equally spaced patch radiators, said equally spaced patch radiators configured in rows and columns, said equally spaced patch radiators further comprising signal phasers, said patch radiators operable at high radio frequencies, said patch radiators defining at least one rectangular grid, said rectangular grid of said patch radiators operable at low frequencies, further said rectangular grid of equally spaced patch radiators operable to define strips of high frequency patch radiators, further said signal phasers being operable in said rectangular grids; and, a ground plane, said ground plane providing a common ground plane to said multiplicity of equally spaced patch.

9. A compact, multi-frequency, antenna array, comprising:

a multiplicity of equally spaced patch radiators, said equally spaced patch radiators, configured in rows and columns, said patch radiators operable at high radio frequencies, further said patch radiators further comprise signal amplifiers, said patch radiators defining at least one rectangular grid, said rectangular grid of said patch radiators operable at low radio frequencies, further said signal amplifiers being operable as said rectangular grid of equally spaced patch radiators and said rectangular grid defines strips of high frequency patch radiators; and, a ground plane, said ground plane providing a common ground plane to said multiplicity of equally spaced patch radiators.

10. A compact, multi-frequency antenna array, comprising:

a multiplicity of equally spaced patch radiators, said patch radiators configured in rows and columns, said patch radiators operable at high radio frequencies, said patch radiators defining at least two rectangular grids, said rectangular grids of said patch radiators operable at low radio frequencies, wherein said rectangular grids are spaced less than one-half wavelength of said low radio frequency apart, further said rectangular grid of equally spaced patch radiators operable to define strips of high frequency patch radiators; and, a multiplicity of ground planes, one of said ground planes cooperatively associated with each of said patch radiators.

11. A compact, multi-frequency antenna array, comprising:

a multiplicity of equally spaced patch radiators, said patch radiators configured in rows and columns, said patch radiators operable in the S-band, said patch radiators defining at least one rectangular grid, said rectangular grid of said patch radiators operable at low radio frequencies, further said rectangular grid of equally spaced patch radiators operable to define strips of high frequency patch radiators; and, a multiplicity of ground planes, one of said ground planes cooperatively associated with each of said patch radiators.

12. A compact, multi-frequency antenna array, comprising:

a multiplicity of equally spaced patch radiators, said patch radiators configured in rows and columns, said patch radiators operable at high radio frequencies, said patch radiators defining at least one rectangular grid, said rectangular grid of said patch radiators operable in the UHF band, further said rectangular grid of equally spaced patch radiators operable to define strips of high frequency patch radiators; and, a multiplicity of ground planes, one of said ground planes cooperatively associated with each of said patch radiators.

13. A compact, multi-frequency antenna array, comprising:

a multiplicity of equally spaced patch radiators, said patch radiators configured in rows and columns, said patch radiators operable at high radio frequencies, said equally spaced patch radiators comprising signal phasers, said patch radiators defining at least one rectangular grid, said rectangular grid of said patch radiators operable at low radio frequencies, further said signal phasers being operable as said rectangular grid, and said rectangular grid of equally spaced patch radiators operable to define strips of high frequency patch radiators; and, a multiplicity of ground planes, one of said ground planes cooperatively associated with each of said patch radiators.

14. A compact, multi-frequency antenna array, comprising:

a multiplicity of equally spaced patch radiators, said patch radiators configured in rows and columns, said patch radiators operable at high radio frequencies, said equally spaced patch radiators comprising signal amplifiers, said patch radiators defining at least one rectangular grid, said rectangular grid of said patch radiators operable at low radio frequencies, further said signal amplifiers being operable as said rectangular grid, and said rectangular grid of equally spaced patch radiators operable to define strips of high frequency patch radiators; and, a multiplicity of ground planes, one of said ground planes cooperatively associated with each of said patch radiators.

* * * * *